US009915401B2

(12) United States Patent
Russikoff et al.

(10) Patent No.: US 9,915,401 B2
(45) Date of Patent: Mar. 13, 2018

(54) MOUNTING SYSTEM AND ASSOCIATED KIT FOR INSTALLING DECORATIVE LIGHTS

(71) Applicants: Dana Russikoff, Philadelphia, PA (US); Ronald K. Russikoff, Philadelphia, PA (US)

(72) Inventors: Dana Russikoff, Philadelphia, PA (US); Ronald K. Russikoff, Philadelphia, PA (US)

(73) Assignee: RODAN ENTERPRISES, LLC, Philadelphia, PA (US)

( * ) Notice: Subject to any disclaimer, the term of this patent is extended or adjusted under 35 U.S.C. 154(b) by 0 days.

(21) Appl. No.: 14/757,173

(22) Filed: Nov. 30, 2015

(65) Prior Publication Data

US 2016/0153644 A1 Jun. 2, 2016

Related U.S. Application Data

(60) Provisional application No. 62/123,889, filed on Dec. 1, 2014.

(51) Int. Cl.
*F21S 4/10* (2016.01)
*F21V 21/02* (2006.01)
(Continued)

(52) U.S. Cl.
CPC . *F21S 4/10* (2016.01); *F21S 4/28* (2016.01); *F21V 21/02* (2013.01); *F21V 21/088* (2013.01); *F21W 2121/00* (2013.01)

(58) Field of Classification Search
CPC .... F21S 4/10; F21S 4/28; F21V 21/02; F21V 21/088; F21W 2121/00
See application file for complete search history.

(56) References Cited

U.S. PATENT DOCUMENTS 4,901,212 A * 2/1990 Prickett ..... F21V 21/08 362/145
4,962,907 A * 10/1990 Gary ..... F21V 19/0005 248/205.3

(Continued)

*Primary Examiner* — Mary Ellen Bowman
(74) *Attorney, Agent, or Firm* — Armand M. Vozzo, Jr.

(57) ABSTRACT

An improved mounting system and associated kit is disclosed for installing decorative lights within a window frame. The present system comprises a support framework assembly of separate tubular track members, each having a slotted opening running along its length and together joined in a substantially rectangular configuration or in an alternative form intended to conform to the shape of the window frame. Separate L-shaped and T-shaped connectors constructed having movable projecting sections are sized and fitted with O-ring members to provide a press-fit engagement with the tubular chambers of the track members at their respective ends and thereby join the tubular track members together in their assembly and secure the assembly in mounted position within the window with the respective slotted openings inwardly facing. A light insertion tool specially formed and used in association with the present system allows the user to complete installation of a string of decorative lights within the slotted openings of the tubular track members with the individual lights set apart equidistantly for optimal aesthetic effect.

20 Claims, 7 Drawing Sheets

(51) Int. Cl.

| | |
|---|---|
| ***F21S 4/28*** | (2016.01) |
| ***F21V 21/088*** | (2006.01) |
| *F21W 121/00* | (2006.01) |

(56) References Cited

U.S. PATENT DOCUMENTS

| | | | | |
|---|---|---|---|---|
| 5,056,747 | A * | 10/1991 | Kireta | F21V 19/006 211/26 |
| 6,179,258 | B1 * | 1/2001 | Dell'Aquila | A47F 11/10 248/208 |
| 2002/0105803 | A1 * | 8/2002 | Deutsch | F21V 21/108 362/145 |
| 2007/0211462 | A1 * | 9/2007 | Dowell | B05B 15/061 362/249.01 |

* cited by examiner

MOUNTING SYSTEM AND ASSOCIATED KIT FOR INSTALLING DECORATIVE LIGHTS

CROSS-REFERENCE TO RELATED APPLICATION

This application is a continuation-in-part of U.S. provisional patent application Ser. No. 62/123,889 filed Dec. 1, 2014 for Mounting System and Associated Kit for Installing Decorative Lights.

BACKGROUND OF THE INVENTION

The present invention relates to window-mounted systems for hanging decorative lighting and, more particularly, to an improved mounting system and associated kit for installing decorative lights within a window frame including a support framework assembly of slotted tubular members specially formed and interconnected so as to be adjustable for mounting in a variety of window frames together with an associated light insertion tool capable of readily installing the individual lights of a decorative light string equally spaced apart within the slotted tubular members.

Throughout the United States and elsewhere, the practice of displaying decorative lighting on homes, apartments and other dwelling units at holiday times has become increasingly wide spread. Traditionally, this practice of displaying holiday lights was most often implemented during the Christmas season, but recently, has become a more frequent and almost year-round exercise in enhancing other holiday celebrations like Valentine's Day, St. Patrick's Day, Easter, Halloween and Thanksgiving. Typically, these holiday light displays utilize a plurality of pre-wired lights of white or a variety of colors in differing lengths or "strings" that are attached to structural elements of the home or other dwelling unit to achieve a decorative effect, with the strings of lights being secured beneath overhanging eaves and around gables, and positioned to outline architectural features of the homes, both inside and outside, such as doorways and windows.

Window frames are especially desirable for displaying holiday lights but not generally suitable for doing so. Traditional methods of displaying holiday lights in a window have involved the use of tape, tacks, nails, suction cups, or other fasteners to hold the light strings in place within the window frame which often damage the area surrounding the window or leave unsightly marks on the window glass. Makeshift mounting systems have been used for years and although the lights are quite attractive when installed, the installation of one string of holiday lights in a window is usually a painstaking activity, with the process of completing light installation on a group of windows, as is often the case, inevitably taking a significant amount of time. Since neither the light strings nor the windows are designed with the idea of simply mounting the lights into the window frames themselves, framework systems formed and adapted to fit standard rectangular window frames have been devised in the prior art to ease the task of light installation upon a given window and reduce the time involved to do so. Many of these prior art framework systems are designed having a support framework made of rigid channels or tubular members that are provided with individual compartments, retaining clips or fitted holes adapted to hold separate lights of a continuous string in a set position. Examples of this type of characteristic framework system are shown and described in U.S. Pat. No. 4,821,158 to Mitten; U.S. Pat. No. 5,700,083 to Boechel; U.S. Pat. No. 5,791,762 to Wroblewski; U.S. Pat. No. 5,954,419 to D'Angelo; and U.S. Pat. No. 6,179,258 to Dell'Aquila. Another type of prior art mounting device used for decorative lighting is formed from an assembly of hollow tubes interconnected by a series of elbows, with the tubes being slit to allow a continuous string of lights to be held in connection with the tubes around the window perimeter at adjustable locations. An example of this such type of prior art device designed to display a continuous light string upon a door frame or window frame without means for set positioning of individual lights is found in U.S. Pat. No. 8,425,075 to Falat et al.

While these and other prior art lighting mounting systems give all indications to work satisfactorily in providing a decorative light display for window frames, they have not been widely accepted and used by the general public due to certain limitations in the ability to fabricate, manufacture and assemble their support framework as well as difficulties in their mounting installations. As a result, they have not been economically affordable and generally been available for implementation and use by the general public. Furthermore, these prior art window frame lighting systems have also been limited to the extent that a user can easily adjust the set positioning of the lights in the resulting display to suit the desire and preference of the user and better complement the size and shape of the window to optimize the decorative effect. Accordingly, there is a genuine need for an improved mounting system and associated kit for installing decorative lights upon a window that is simple in construction and assembly and economical to produce and that can provide the user with greater ease of implementation and adjustment of the lighting positions than heretofore afforded by the prior art.

SUMMARY OF THE INVENTION

Accordingly, it is a general purpose and object of the present invention to provide an improved mounting system for installing decorative lights in and around windows of different sizes and configurations in a customized manner with maximum aesthetic appeal.

A more particular object of the present invention is to provide a customized mounting system for displaying holiday lights within a window frame that is simple to assemble and easy to implement in connection with a variety of window units in a building structure.

Another object of the present invention is to provide an improved window mounting holiday light display system that is customized for and easily installed into any window frame and can be readily removed without damaging the frame and stored with ease for subsequent installation the following holiday season.

Still another object of the present invention is to provide an improved window mounting light display system that can be easily adjusted particularly with regard to the positioning of the lights in the resulting display to optimize the decorative effect and better complement the size and shape of the associated window.

A still further object of the present invention is to provide an improved window mounting light display system that is inexpensive to manufacture and economical to produce, reliable in its performance and usable year after year.

Briefly, these and other objects of the present invention are accomplished by an improved mounting system and associated kit for installing decorative lights within a window frame. The present decorative light mounting system comprises a support framework assembly of separate tubular track members, each having a slotted opening running along its length and together joined in a substantially rectangular configuration or in an alternative form intended to conform to the shape of the window frame. Separate L-shaped and T-shaped connectors each constructed having pivotable projecting sections are sized and fitted with O-ring members to provide a press-fit engagement with the tubular chambers of the track members at their respective ends and thereby join the tubular track members together in their assembly and secure the assembly in mounted position within the window with the respective slotted openings inwardly facing. A light insertion tool specially formed and used in association with the present system allows the user to complete installation of a string of decorative lights within the slotted openings of the tubular track members with the individual lights set apart equidistantly for optimal aesthetic effect.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DESCRIPTION OF THE INVENTION

Figure 1:
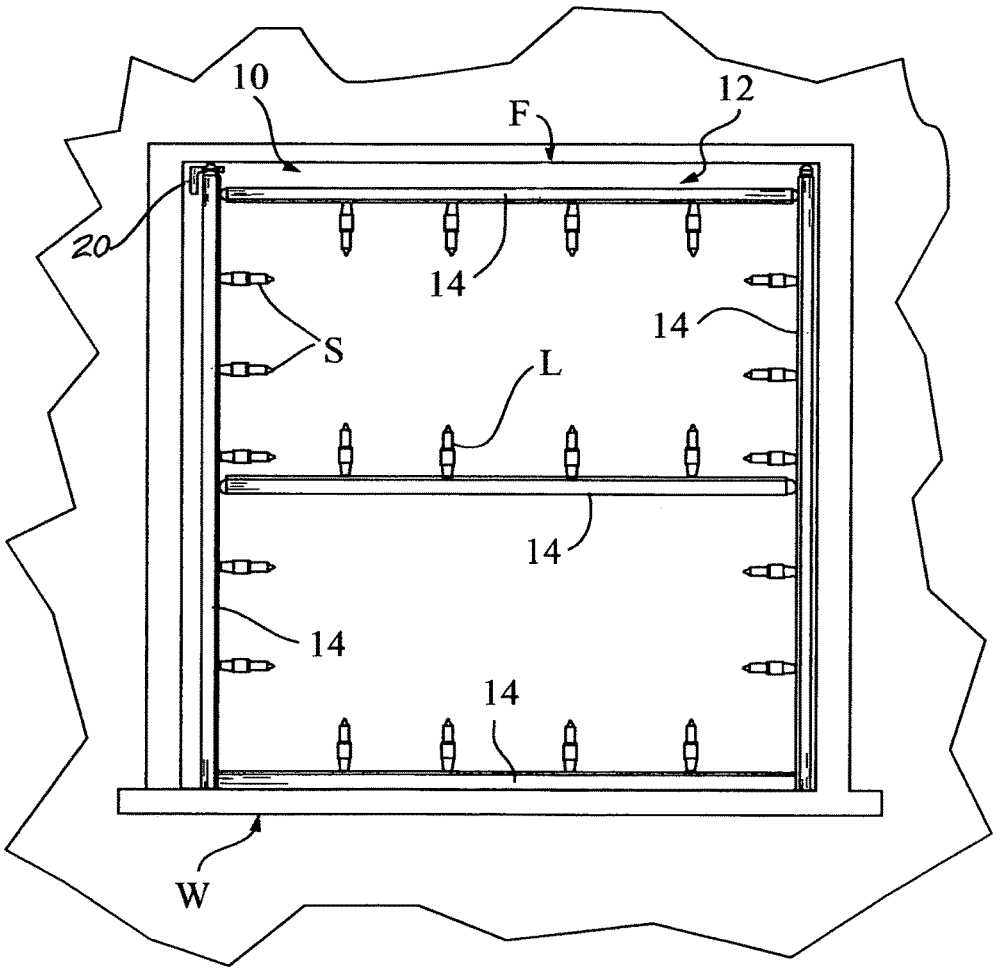
FIG. 1 is a front elevation view of a preferred embodiment of the decorative light mounting system with its support framework assembly installed within a rectangular window frame in accordance with the present invention.

The following serves to describe a preferred embodiment of the present invention and the best presently contemplated mode of its production and practice. This description is further made for the purpose of illustrating the general principles of the invention but should not be taken in a limiting sense, the scope of the invention being best determined by reference to any associated claims.

Referring to the drawings, the following is a list of structural componens of the present decorative light mounting system, generally designated 10, and those associated structural elements shown employed in connection with the present invention:

10 decorative light mounting system;
12 support framework assembly;
14 tubular track member;
14*a* slot opening;
16 L-shaped connector;
16*a* upright section;
16*b* base section;
16*c* rotational connection;
17 O-ring members;
18 T-shaped connector;
18*a* transverse section;
18*b* stem section;
18*c* rotational connection;
19 O-ring members;
20 snap clamp member;
22 mounting segment;
24 clamping segment;
26 cutout section;
30 light insertion tool;
31 tool column:
32 tool body;
33 wedged end;
34 slot;
36 top/upper pad;
L decorative light elements;
S string of decorative lights;
F window frame; and
W window.

Referring initially to FIG. 1, the present decorative light mounting system 10 is shown installed in a typical rectangular window W, secured in place within the frame F of the window and carrying a plurality of individual decorative light elements L in one or more continuous light strings S. In accordance with the present invention, the decorative light mounting system 10 comprises a support framework assembly 12 made up of a plurality of separate tubular track members 14, each intended to hold one or more of the light elements L along a light string S. In the embodiment of FIG. 1, the tubular track members 14 in the framework assembly 12 are relatively rigid in their form, preferably made of a plastic material in molded extrusions cut in lengths, and are joined together in a substantially rectangular configuration intended to conform substantially to the shape of the window frame F. On the perimeter of the support frame assembly 12, respective ones of the tubular track members 14 are thus positioned, each in relatively close alignment with an interior side of the window frame F with an additional tubular track member being transversely positioned, as shown in FIG. 1, and held within the framework assembly 12 across the width of the window frame through the middle of its elevation.

Figure 2:
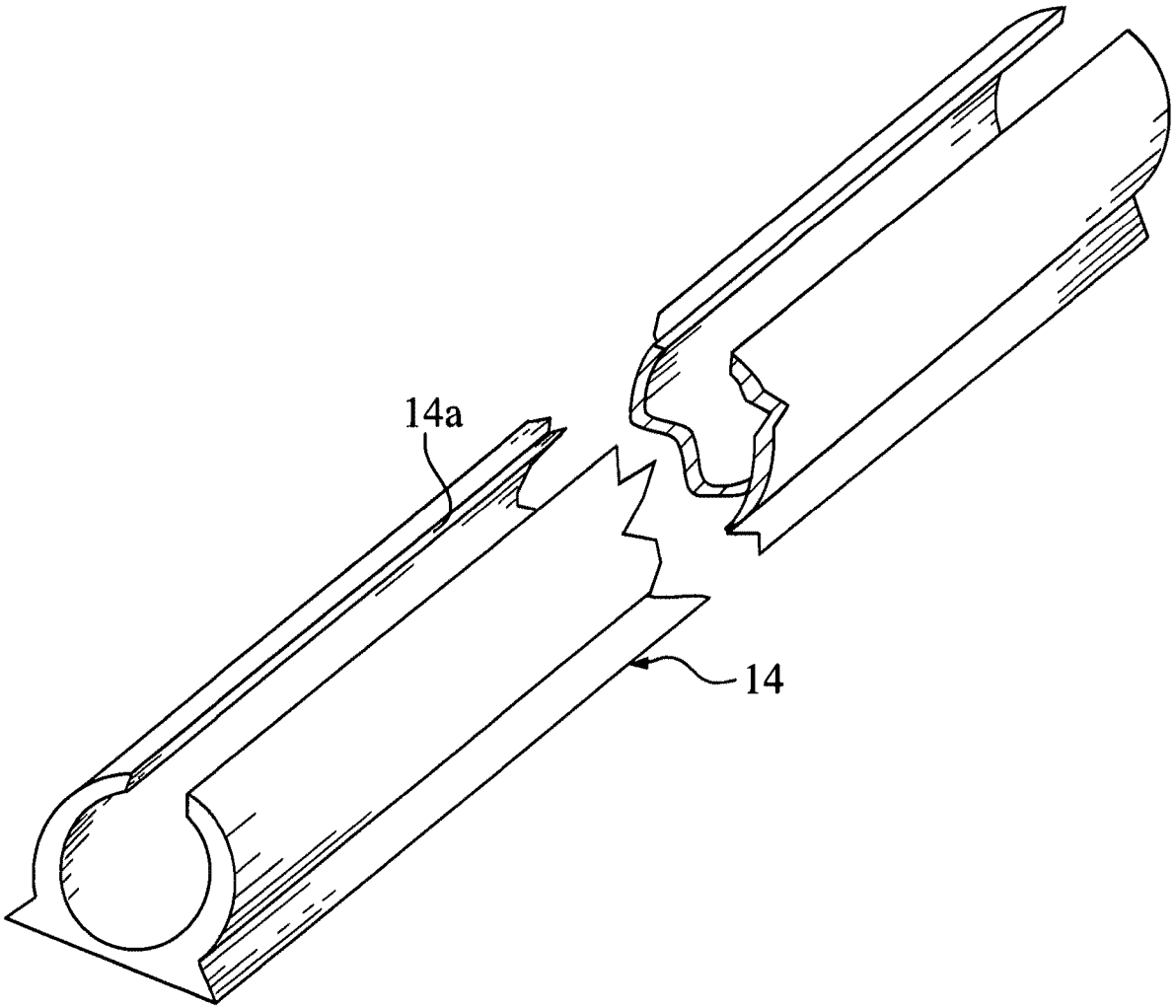
FIG. 2 is a longitudinal perspective view of an exemplary tubular track member used in the support framework assembly of the present light mounting system shown in FIG. 1.

As best seen in FIG. 2, each of the tubular track members 14 is formed having a slotted opening running 14*a* along its length through to the interior chamber of the track member. The width of the slotted opening 14*a* is sufficient in its dimension to engage the standard-sized lower body casings typically used to hold conventional mini-lights and maintain their electrical connections in commercially available light strings S. It should be noted and understood that even though the tubular track members 14 are relatively rigid in their form, there is a sufficient flexibility to allow the slotted openings 14*a* to expand slightly in order to fit the lower body casings of the individual light elements L when pressed into place and then retract thereupon to its normal width after the light element is released in the slotted opening to hold it in place with much like a spring-loaded clamping action. The slotted openings 14*a* of the respective tubular track members 14 assembled in the support framework 12 are intended and preferably positioned to be facing inwardly of the window frame F so that the individual light elements L upon their inserted engagement within the slotted openings, as described below in greater detail, will present a similar inwardly facing decorative light pattern as shown in FIG. 1.

In the rectangular configuration of the support framework assembly 12 seen in FIG. 1, a pair of the tubular track members 14 of equal lengths are secured in an upright attitude along opposite sides of the window frame F using alternative means. On the upper left side of the support framework assembly 12 shown in FIG. 1, the upright attitude of the tubular track member 14 is held and maintained by a snap clamp member 20, described in greater detail below, that is attached to the interior of the window frame F. On the opposite side of the support framework assembly 12, the upright tubular track member 14 is alternatively maintained by means of the wedged-pressed fit provided by one of projecting sections of either of those connectors 16 or 18 as described in greater detail below. It should be noted and understood that either of these structural elements may be utilized in accordance with the present invention to maintain the upright position of the tubular track members 14 within the window frame F where needed.

To further construct the support framework assembly 12 and complete its installation, tubular track members 14 are transversely positioned in a substantially horizontal attitude and connected between the upright track members on either side, at least one of these respective transverse tubular track members being disposed at the top and bottom of the upright track members with their respective slotted openings 14*a* also facing inwardly of the window frame F. The respective upright and transverse tubular track members 14 are joined together at the respective corners of the framework assembly 12 and in the central portion thereof with specially formed L-shaped connectors 16 and T-shaped connectors 18, each as detailed below with respective pivotable projecting sections 16*a*, 16*b* and 18*a*, 18*b* that are sized and fitted with O-ring washer members 17 and 19 to provide a press-fit engagement with the tubular chambers of the track members at their respective ends.

Figure 3:
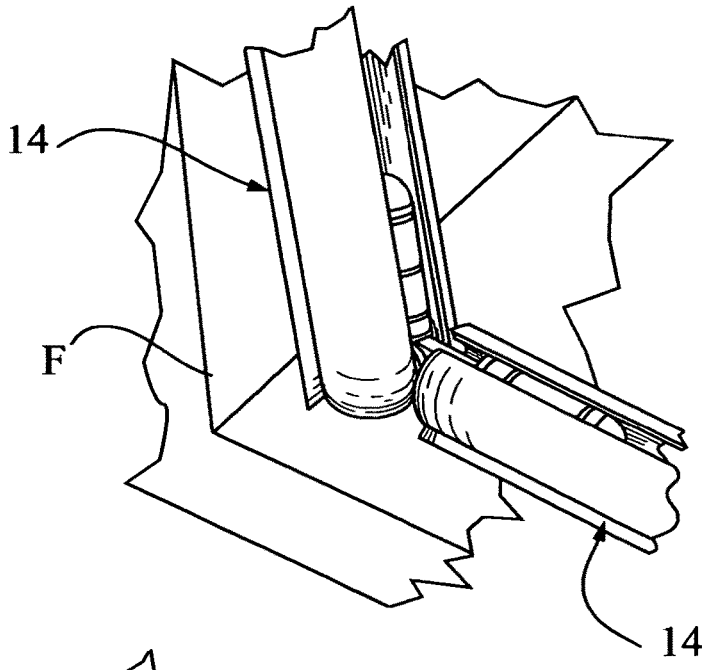
FIG. 3 is an enlarged perspective view of the bottom corner region of the support framework assembly, here being on the left side thereof shown in FIG. 1.
Figure 4:
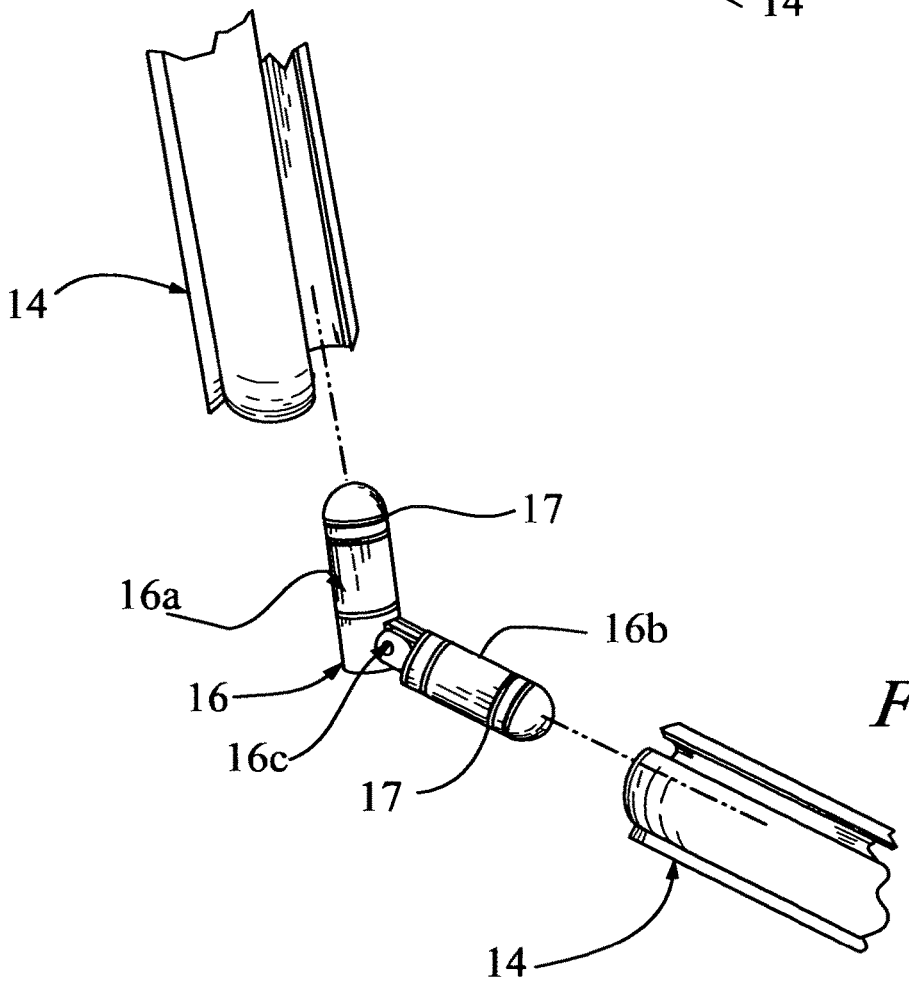
FIG. 4 is an exploded perspective view of the bottom corner region of the support framework assembly shown in FIG. 3.
Figure 5:
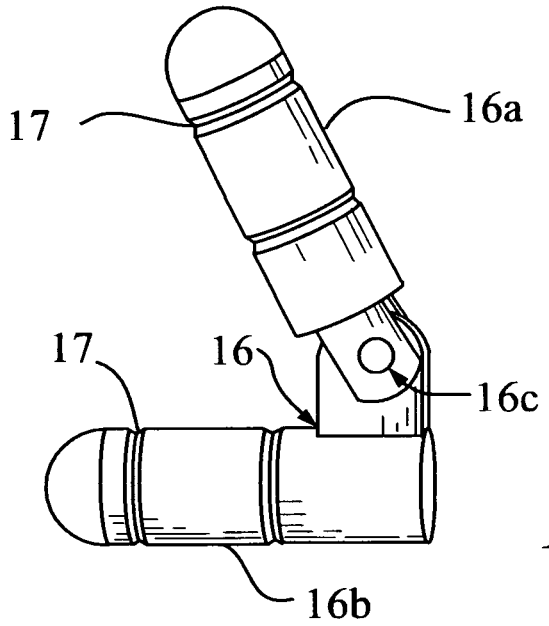
FIG. 5 is a perspective view of the L-shaped connector shown in FIG. 4, here isolated to feature its pivotable structure.

Referring now to FIGS. 3, 4 and 5 in conjunction with FIG. 1, the respective upright and transverse tubular track members 14 are joined together at the corners of the support framework assembly 12 and installed within the window frame F using L-shaped connectors 16. Each L-shaped connector 16 comprises a pair a plug-like section members, one an upright section member 16*a* and the other a base section member 16*b*, together joined at their base ends and made to project therefrom at a substantially right angle to each other. The upright and base section members 16*a* and 16*b* are made of a relatively rigid and durable material, such as a plastic, each longitudinally formed having a substantially cylindrical configuration with a diameter sized to fit the tubular chamber of each track member 14 and a rounded end preferably formed opposite to their respective base ends to facilitate engagement with the track chambers. Each of the respective section members 16*a* and 16*b* of the L-shaped connectors 16 are further provided with a series of circular grooves formed into and about the cylindrical surface of the section members at spaced positions along their length. The series of circular grooves on each of the section members 16*a* and 16*b* are sized and fitted to hold and maintain a respective series of O-ring washers 17, one in each groove, along the respective cylindrical surfaces of the section members. The O-ring washers 17 are sized in their respective inner and outer diameters to snap in place within the respective grooves along the section members 16*a* and 16*b* and therein compress when inserted into the tubular chambers of the track members 14 so that each L-shaped connector 16 will provide and maintain a press-fit engagement with the tubular track members at their respective ends. As best seen in FIGS. 4 and 5, joinder between the respective section members 16*a* and 16*b* of the L-shaped connector 16 is made by a rotational connection 16*c*, such as a hinge pin or the like, established between the section members at their base ends to allow the respective section members to pivot relative to each other from their operative right angle position. This ability of the section members 16*a* and 16*b* to hinge is preferred in order to allow a certain degree of adjustable play in the cornering connection provided by the L-shaped connectors 16 and further allows the connected support framework assembly 12 to be easily folded-up and stored when not in use.

Figure 6:
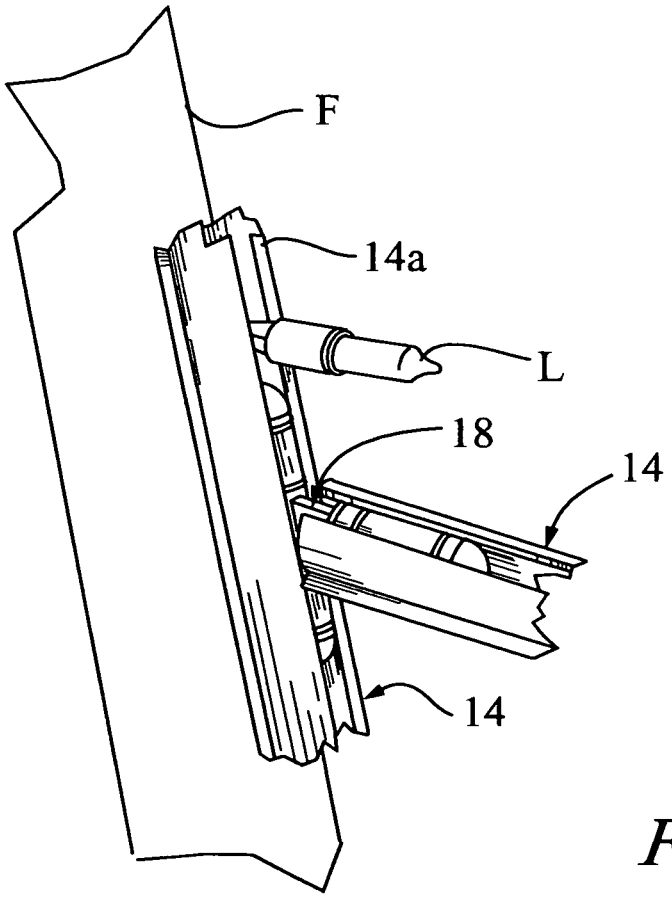
FIG. 6 is an enlarged perspective view of the middle region of the support framework assembly, here being on the left side thereof shown in FIG. 1.
Figure 7:
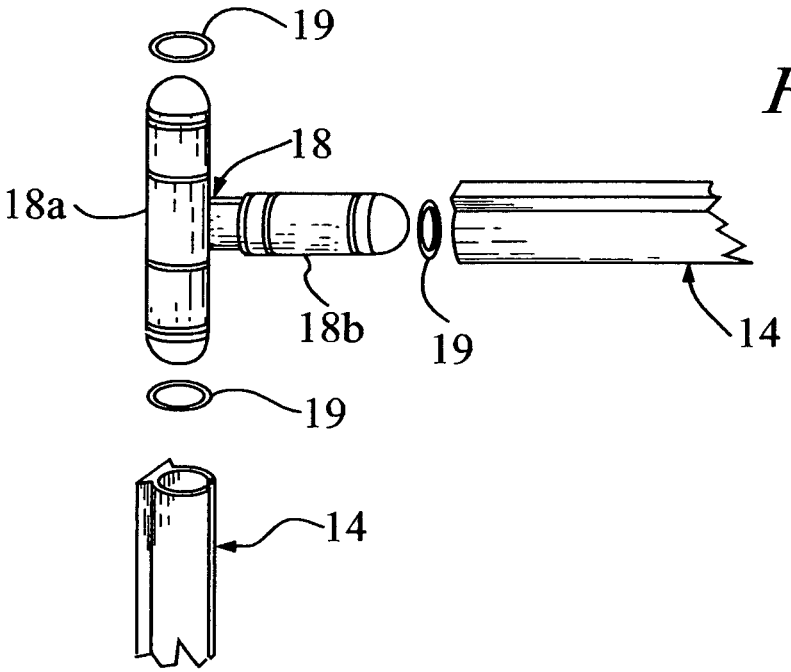
FIG. 7 is an exploded perspective view of the middle region of the support framework assembly shown in FIG. 6.
Figure 8:
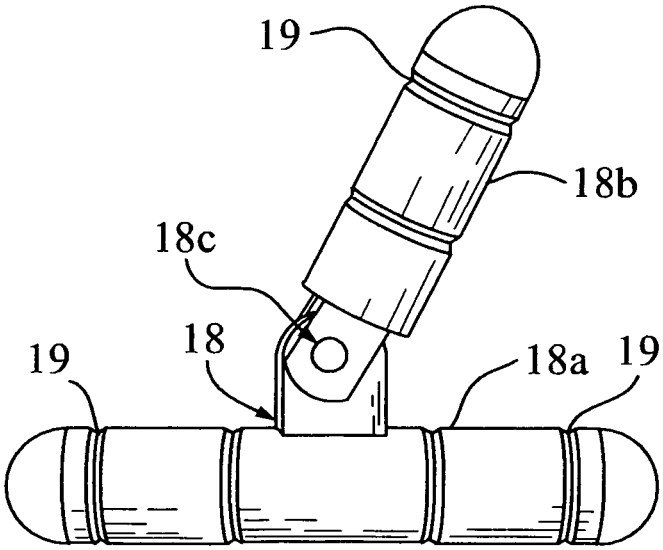
FIG. 8 is a perspective view of the T-shaped connector shown in FIG. 7, here isolated to feature its pivotable structure.

Referring now to FIGS. 6, 7 and 8 in conjunction with FIG. 1, the respective upright and central tubular track members 14 are joined together in the middle of the support framework assembly 12 by respective T-shaped connectors 18 on both sides. Each T-shaped connector 18 comprises a pair a plug-like section members, one a transverse section member 18*a* and the other a stem section member 18*b*, together joined at the base end of the stem section member to the middle portion of the transverse section member so that each member projects therefrom at a substantially right angle to each other. Made of a relatively rigid and durable material, such as a plastic, the transverse and stem section members 18*a* and 18*b* are each longitudinally formed having a substantially cylindrical configuration with a diameter sized to fit the tubular chamber of each track member 14. To facilitate their respective engagement with the tubular track chambers, the transverse section member 18*a* has rounded surfaces formed at opposite ends thereof while the stem section member 18*b* is provided with a similarly formed rounded surface at the projecting end thereof opposite to its base end where joinder of the respective members is made. Like that of the L-shaped connectors 16, each of the respective section members 18*a* and 18*b* of the T-shaped connectors 18 are further provided with a series of circular grooves formed into and about the cylindrical surface of the section members at spaced positions along their length. The series of circular grooves on each of the section members 18*a* and 18*b* are sized and fitted to hold and maintain a respective series of O-ring washers 19, one in each groove, along the respective cylindrical surfaces of the section members. The O-ring washers 19, like those of O-ring members 17, are sized in their respective inner and outer diameters to snap in place within the respective grooves along the section members 18*a* and 18*b* and therein compress when inserted into the tubular chambers of the track members 14 so that each T-shaped connector 18 will provide and maintain a press-fit engagement with the tubular track members. As best seen in FIG. 8, joinder between the respective section members 18*a* and 18*b* of the T-shaped connector 18 is made by a rotational connection 18*c*, such as a hinge pin or the like, established between the section members to allow the respective section members to pivot relative to each other from their operative right angle position. This ability of the section members 18*a* and 18*b* to hinge is preferred in order to allow a certain degree of adjustable play in the connection provided by the T-shaped connectors 18 and further allows the connected support framework assembly 12 to be easily folded-up and stored when not in use.

Figure 9:
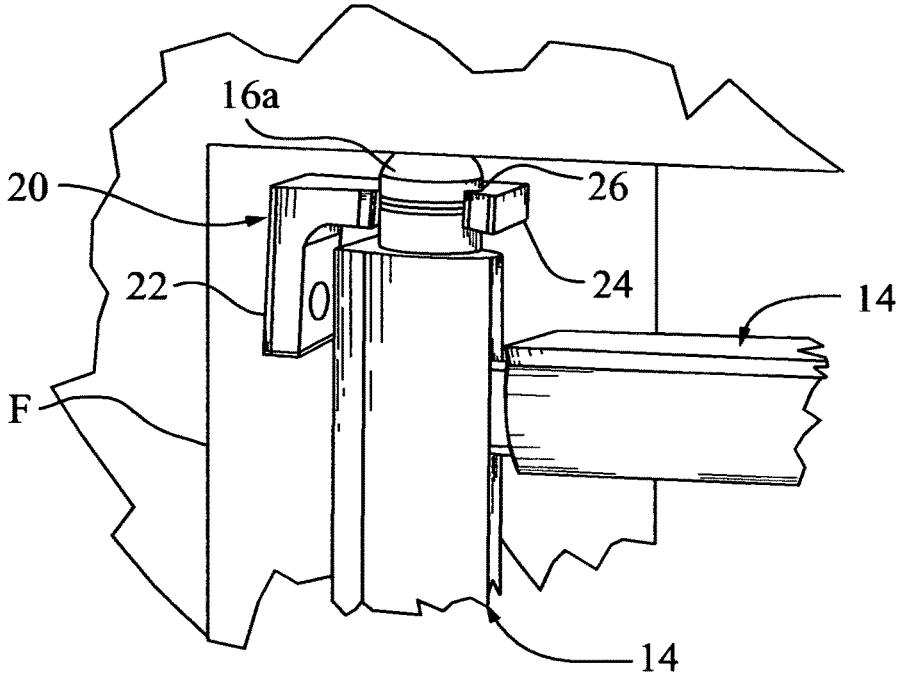
FIG. 9 is an enlarged perspective view of the upper corner region of the support framework assembly, here being on the left side thereof shown in FIG. 1.

Referring now to FIG. 9 in conjunction with FIG. 1, the snap clamp member 20 is used as an alternative or supplemental means to secure the support framework assembly 12 in place within the window frame F, serving to maintain an uprightly stationed tubular track member 14 in an upper corner of the support framework assembly. The snap clamp member 20 is made of a relatively rigid and durable material, such as a plastic, and is integrally formed having a mounting surface segment 22 and clamping surface segment 24 with a cutout section 26 therein perpendicularly disposed to each other. The mounting surface segment 22 is formed and adapted to abut the interior surface of window frame F and be connected thereto by conventional attachment means so that the clamping surface segment 24 projects from the interior window frame in proximity to the top of the frame. The cutout section 26 formed in the clamping surface segment 26 is sized to fit the protruding end of the upright section member 16*a* of the L-shaped connector 16 used for the corner joint of tubular track members 14 and further serves to provide a press-fit engagement therewith about the O-ring washer member 17 positioned near the protruding end of the section member.

Figure 10:
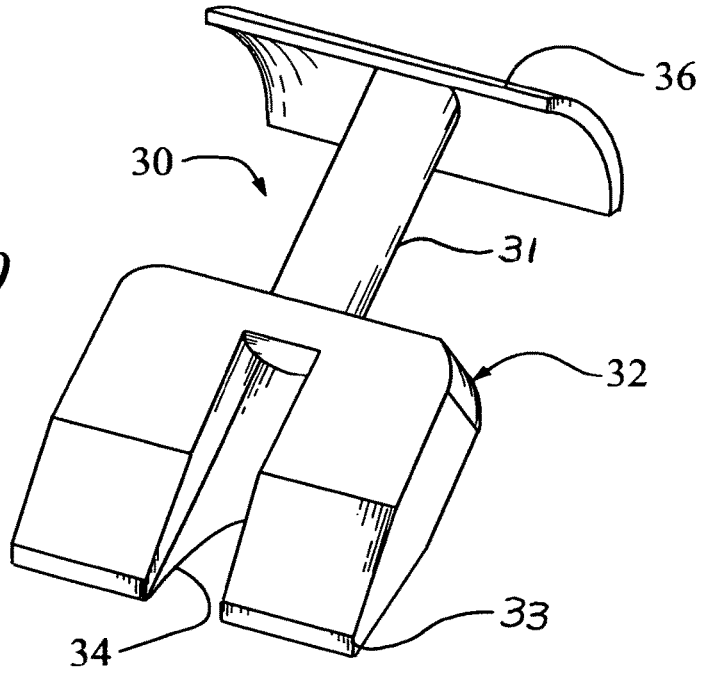
FIG. 10 is a perspective view of the light insertion tool used in association with the present decorative light mounting system of FIG. 1.

Referring now to FIG. 10, a light insertion tool 30 is used in association with the present decorative light mounting system 10 to facilitate the installation of lights within the slotted openings 14*a* of the tubular track members 14 with the individual light elements L set apart equidistantly for optimal aesthetic effect. The light insertion tool 30 is preferably made of a relatively rigid and durable material, such as a plastic, and is specially formed comprising a lower body 32, an upper pad 36, and a column segment 31 connected therebetween. The lower body 32 of the insertion tool 30 has a generally rectangular outer configuration with a wedge-shaped bottom edge 33 across the body surface and a slot 34 centrally formed therein from near the top of the body to its wedge-shaped bottom edge. The slot 34 is sized and shaped to fit an individual light element L and its lower casing within the confines of the slot and allows the user of the insertion tool 30 to move the light element in and along the tubular track member 14 into which the light element is to be inserted. The wedge-shaped bottom edge 33 of the tool body 32 is formed to engage the slotted opening 14*a* of the tubular track members 14 and serves to open the slot slightly to allow insertion of the light element L and its lower casing into the slotted opening and a press-fit engagement within the tubular track member 14 intended to hold the light element.

Figure 11A:
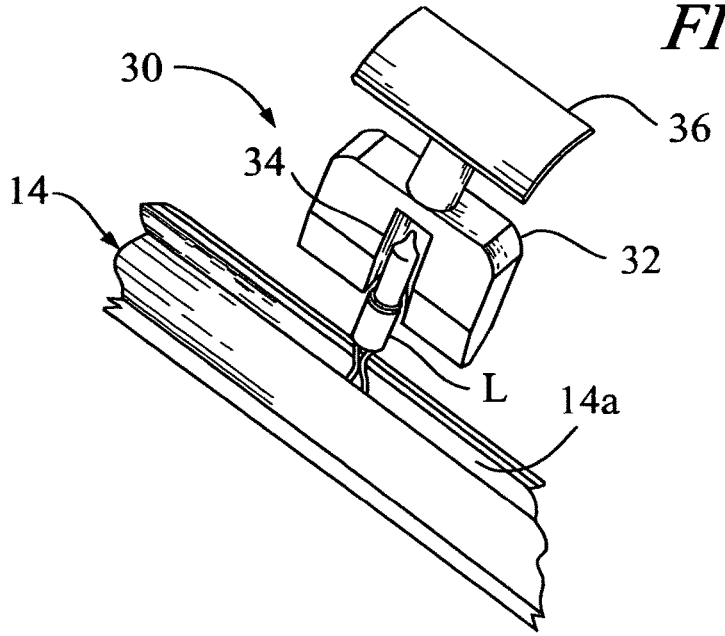
FIGS. 11*a* and 11*b* are separate perspective views of the light insertion tool as used in accordance with the present invention.
Figure 11B:
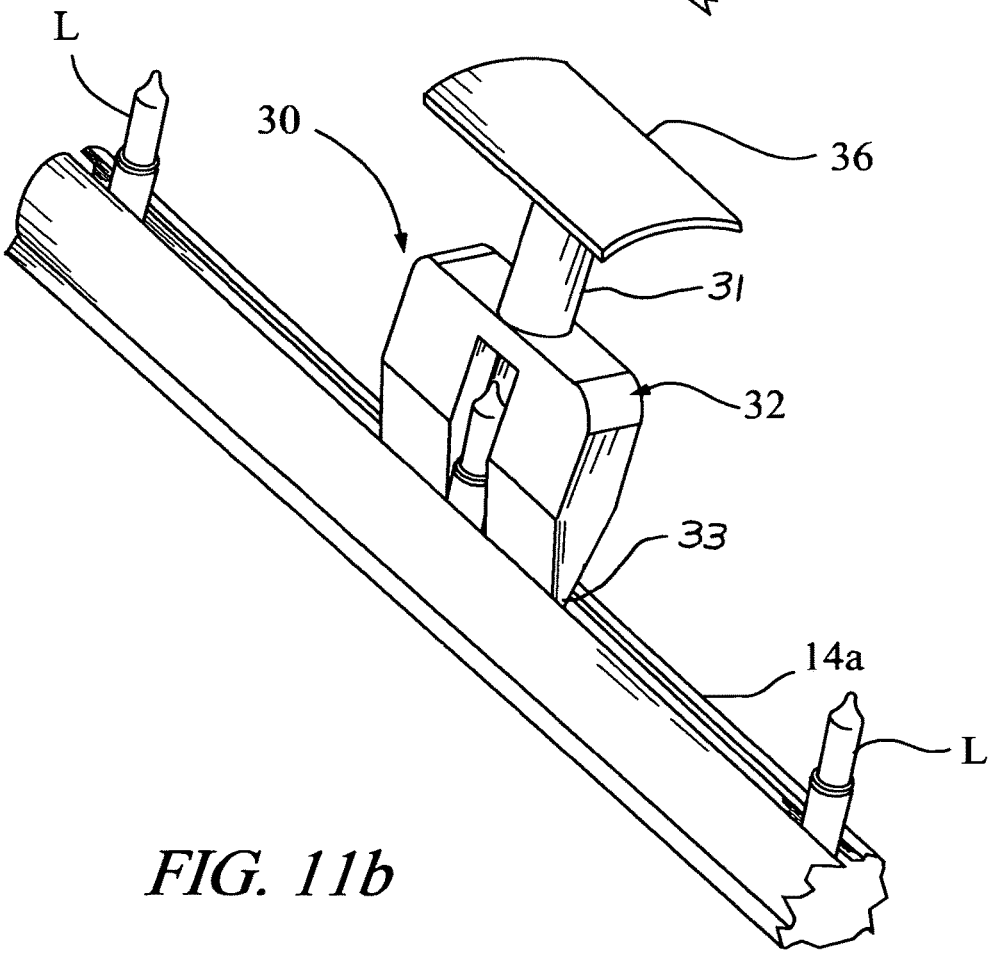

Referring now to FIGS. 11*a* and 11*b* in conjunction with FIG. 10, the tool insertion tool 30 is best utilized in accordance with the present decorative light mounting system 10 by positioning the individual light element L into the center slot 34 of the tool body 32 and holding the upper pad 36 for direction, aligning the light element and its associated lower casing and wires with the slotted opening 14*a* of the tubular track member 14 intended for light insertion, as depicted in FIG. 11*a*. Upon determining the desired location of the light element L along the tubular track member 14, the tool body 32 carrying the light element is pressed into the slotted opening 14*a* with its wedged-shaped bottom edge 33 slightly widening the slotted opening, as shown in FIG. 11*b*, and allowing the light element L and its associated lower casing to be press-fit into the opening and held there in place by the clamping pressure of the retracted slotted opening Therefore, it is apparent that the described invention generally provides an improved mounting system for installing decorative lights in and around windows of different sizes and configurations in a customized manner with maximum aesthetic appeal. More particularly, the present invention provides a customized mounting system for displaying holiday lights within a window frame that is simple to assemble and easy to implement in connection with a variety of window units in a building structure. The present invention further provides an improved window mounting holiday light display system that is customized for and easily installed into any window frame and can be readily removed, if necessary, without damaging the frame so that it can be stored with ease for subsequent installation the following holiday season. The present mounting system and its associated light insertion tool also provides an enhanced decorative window display for any holiday season that can be easily adjusted particularly with regard to the positioning of the lights in the resulting display to optimize the decorative effect and better complement the size and shape of the associated window. The present light mounting system and associated light insertion tool are relatively inexpensive to manufacture and economical to produce, are reliable in their performance and usable year after year.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. For example, using the rotational ranges of the respective L-shaped and T-shaped connectors, 16 and 18, the rectangular configuration of the support framework assembly 12, as shown in FIG. 1 and described above, may be altered in form and arrangement and provided within the scope of the present invention to conform to different window frames other than rectangular. Furthermore, certain modifications to the described embodiment that serve to benefit its usage are within the scope of the present invention. Accordingly, it is understood that this invention is not limited to the particular embodiment described, but rather is intended to cover modifications within the spirit and scope of the present invention as expressed in the appended claims.

What is claimed is:

1. A mounting system for installing strings of decorative lights upon a window frame in a pattern conforming to the shape of the window, comprising:

a first set of track members having a chamber formed along the length thereof to hold the strings of decorative lights therein and assembled together in a perimeter configuration corresponding to the shape of the window, each of said first set of track members being constructed having a slotted opening extending the length of the chamber and a width to the slotted opening sufficient in dimension to engage separate decorative lights in the strings in position facing inwardly of the window frame in the pattern conforming to the shape of the window; and a plurality of L-shaped connector members each having a joint pair of plug-like sections transversely disposed relative to each other and pivotally connected together, the plug-like sections of each L-shaped connector member being adapted for press-fit engagement of the chambers of said first set of track members to secure the assembled perimeter configuration thereof in place within the window frame.

2. A mounting system according to claim 1, further comprising:

a clamp member adapted to mount upon the window frame and formed to engage a portion of the assembled perimeter configuration of said first set of track members for securing placement thereof within the window frame.

3. A mounting system according to claim 1, further comprising:

at least one of a second set of track members having a chamber formed along the length thereof to hold a respective string of decorative lights, said second set of track members being transversely disposed within the perimeter configuration of said first set of track members and assembled thereto, each of said second set of track members being constructed having a slotted opening along the length of the respective chamber thereof and a width to the slotted opening sufficient in dimension to engage separate decorative lights in the string facing inwardly of the window frame; and a plurality of T-shaped connector members each having a joint pair of plug-like sections transversely disposed relative to each other and pivotally connected together, the plug-like sections of each T-shaped connector member being adapted for press-fit engagement of the chambers of said first and second set of track members to secure said track members together and in place within the window frame.

4. A mounting system according to claim 1, wherein each of the joint pair of plug-like sections of said L-shaped connector members are cylindrical in form having a diameter sized to fit the chamber of each of said track members and a rounded end surface to facilitate press-fit engagement with the chambers.

5. A mounting system according to claim 4, wherein each of the joint pair of plug-like sections of said L-shaped connector members are further provided with at least one circular groove formed into and about the cylindrical surface of the respective sections and an O-ring washer member compressible in form contained in place within each groove.

6. A mounting system according to claim 3, wherein the perimeter configuration of the assembled first set of track members is rectangular.

7. A mounting system according to claim 3, wherein each of the joint pair of plug-like sections of said T-shaped connector members are cylindrical in form having a diameter sized to fit the chamber of each of said track members and a rounded end surface to facilitate press-fit engagement with the chambers.

8. A mounting system according to claim 7, wherein each of the joint pair of plug-like sections of said T-shaped connector members are further provided with at least one circular groove formed into and about the cylindrical surface of the respective sections and an O-ring washer member compressible in form contained in place within each groove.

9. A system for displaying strings of decorative lights upon a window in a pattern conforming to the shape of the window frame, comprising:

a first set of track members each having a chamber formed along the length thereof to hold the strings of decorative lights therein and assembled together in a perimeter configuration corresponding to the shape of the window frame, each of said first set of track members being constructed having a slotted opening extending the length of the chamber and a width to the slotted opening sufficient in dimension to hold separate decorative lights in the strings in position facing inwardly of the window frame and about the window;

a plurality of L-shaped connector members each having a joint pair of plug-like sections pivotally connected together and rotatable relative to each other, the plug-like sections of each L-shaped connector member being adapted for press-fit engagement of the chambers of said first set of track members to secure the assembled perimeter configuration thereof in place within the window frame;

at least one of a second set of track members having a chamber formed along the length thereof to hold a respective string of decorative lights, said second set of track members being transversely disposed within the perimeter configuration of said first set of track members and assembled thereto, each of said second set of track members being constructed having a slotted opening along the length of the respective chamber thereof and a width to the slotted opening sufficient in dimension to hold separate decorative lights in the string facing inwardly of the window frame; and a plurality of T-shaped connector members each having a joint pair of plug-like sections pivotally connected together and rotatable relative to each other, the plug-like sections of each T-shaped connector member being adapted for press-fit engagement of the chambers of said first and second set of track members to secure said track members together and in place within the window frame.

10. A system according to claim 9, further comprising:

clamp means for securing position of the assembled sets of track members within the window frame.

11. A system according to claim 10, wherein said clamp means comprises:

a clamp member adapted to mount upon the window frame and formed to engage a portion of the assembled perimeter configuration of said first set of track members for securing the position thereof within the window frame.

12. A system according to claim 9, wherein each of the joint pair of plug-like sections of said L-shaped and T-shaped connector members are cylindrical in form having a diameter sized to fit the chamber of each of said track members and a rounded end surface to facilitate press-fit engagement with the chambers.

13. A system according to claim 12, wherein each of the joint pair of plug-like sections of said L-shaped and T-shaped connector members are further provided with at least one circular groove formed into and about the cylindrical surface of the respective sections and an O-ring washer member compressible in form contained in place within each groove.

14. A system according to claim 9, wherein the perimeter configuration of the assembled first set of track members is rectangular and said second set of track members is disposed laterally therethrough.

15. An installation kit for displaying strings of decorative lights upon a window in a pattern conforming to the shape of the window frame, comprising:

a plurality of track members each having a chamber formed along the length thereof to hold the strings of decorative lights therein and assembled together in a perimeter configuration corresponding to the shape of the window frame, each of said first set of track members being constructed having a slotted opening extending the length of the chamber and a width to the slotted opening sufficient in dimension to hold separate decorative lights in the strings in position facing inwardly of the window frame and about the window;

a plurality of connector members each having a joint pair of plug-like sections pivotally connected together and rotatable relative to each other, the plug-like sections of each connector member being adapted for press-fit engagement of the chambers of said plurality of track members to secure the assembled perimeter configuration thereof in place within the window frame; and a light insertion tool formed to engage separate decorative lights on the strings and adapted to facilitate manual movement of the decorative lights in place within the slotted openings of said plurality of track members.

16. An installation kit according to claim 15, wherein said light insertion tool comprises:

a tool body member formed having a substantially rectangular configuration and a wedge-shaped edge across the bottom of said tool body member formed to engage the slotted openings of said plurality of track members, said tool body member further having a slot centrally formed therein sized and shaped to fit individual decorative lights within the slot to assist manual placement of the decorative lights within the slotted openings of said track members.

17. An installation kit according to claim 16, wherein said light insertion tool further comprises a pad member coupled to the top of said tool body member to assist manipulation thereof.

18. An installation kit according to claim 15, further comprising:

a clamp member adapted to mount upon the window frame and formed to engage a portion of the assembled perimeter configuration of said plurality of track members for securing the position thereof within the window frame.

19. An installation kit according to claim 15, wherein each of the joint pair of plug-like sections of said connector members are cylindrical in form having a diameter sized to fit the chamber of each of said track members and a rounded end surface to facilitate press-fit engagement with the chambers.

20. An installation kit according to claim 19, wherein each of the joint pair of plug-like sections of said connector members are further provided with at least one circular groove formed into and about the cylindrical surface of the respective sections and an O-ring washer member compressible in form contained in place within each groove.

* * * * *